US007438001B2

(12) United States Patent
Nakamura et al.

(10) Patent No.: US 7,438,001 B2
(45) Date of Patent: Oct. 21, 2008

(54) CAR BODY STRUCTURE

(75) Inventors: Hideyuki Nakamura, Kudamatsu (JP); Takashi Furukawa, Kudamatsu (JP); Takashi Yoshida, Shunan (JP)

(73) Assignee: Hitachi, Ltd., Tokyo (JP)

( * ) Notice: Subject to any disclaimer, the term of this patent is extended or adjusted under 35 U.S.C. 154(b) by 269 days.

(21) Appl. No.: 11/217,288

(22) Filed: Sep. 2, 2005

(65) Prior Publication Data

US 2006/0225604 A1 Oct. 12, 2006

(30) Foreign Application Priority Data

Apr. 6, 2005 (JP) ..... 2005-109591

(51) Int. Cl.
*B61D 17/00* (2006.01)

(52) U.S. Cl. ..... 105/396; 105/413; 105/418; 52/45

(58) Field of Classification Search ..... 105/396, 105/397, 404, 411, 413, 418; 52/45, 46, 52/48, 51, 53
See application file for complete search history.

(56) References Cited

U.S. PATENT DOCUMENTS

| | | | | |
|---|---|---|---|---|
| 1,679,460 | A | 8/1928 | Williams | |
| 2,155,677 | A | 3/1937 | Nystrom | |
| 2,083,553 | A * | 6/1937 | Blomberg | 105/397 |
| 3,102,498 | A | 9/1963 | Dean | |
| 6,237,989 | B1 * | 5/2001 | Ammerlaan et al. | 105/397 |
| 6,550,397 | B2 * | 4/2003 | Kawasaki et al. | 105/397 |

FOREIGN PATENT DOCUMENTS

| | | |
|---|---|---|
| CN | 85 1 01670 A | 1/1987 |
| DE | 2452565 | 5/1976 |
| DE | 3318770 | 1/1983 |
| EP | 1118521 | 7/2001 |
| JP | 02-246863 | 10/1990 |

* cited by examiner

*Primary Examiner*—Lars A Olson
(74) *Attorney, Agent, or Firm*—Antonelli, Terry, Stout & Kraus, LLP.

(57) ABSTRACT

The invention provides a railway car with superior riding quality by improving the flexural rigidity of the car body structure while suppressing increase of body structure mass. A reinforcing plate 7 is attached to a roof construction 1 on the side facing an inner side of the car body at a longitudinal center portion of a railway car body structure 10 composed of a roof construction 1, a side construction 2, an underframe 3 and an end construction 4. The range in which the reinforcing plate 7 is adhered in the longitudinal direction of the railway car body structure 10 is between two body bolsters 6, and the range in which the plate 7 is adhered in the horizontal direction of the roof construction 1 is approximately half the length of the roof construction 1 in the horizontal direction. The thickness of the reinforcing plate 7 is increased gradually as the height of the roof construction 1 in the vertical direction increases. According to this arrangement, the deformation of the roof construction 1 at the longitudinal center portion of the railway car body structure 10, which is excessive without the present arrangement, is suppressed, and the flexural rigidity of the railway car body structure 10 is effectively improved. In other words, the bending vibration of the railway car body in the vertical direction can be suppressed, and a superior riding quality is provided.

5 Claims, 19 Drawing Sheets

CAR BODY STRUCTURE

The present application is based on and claims priority of Japanese patent application No. 2005-109591 filed on Apr. 6, 2005, the entire contents of which are hereby incorporated by reference.

BACKGROUND OF THE INVENTION

1. Field of the Invention

The present invention relates to an arrangement of a car body structure of a railway car, a monorail car or the like.

2. Description of the Related Art

A railway car body structure is composed of a roof construction constituting the upper face thereof, two side constructions constituting the side walls thereof, an underframe constituting the lower face thereof, and two end constructions constituting the ends thereof. In recent years, in order to mainly reduce the weight of the car body and to improve the productivity thereof, hollow extrusions made of aluminum alloy are used to construct the roof construction, the side constructions and the underframe, and extrusions with ribs made of aluminum alloy are used to construct the end constructions. This art is disclosed in Japanese Patent No. 2604226 (patent document 1).

In a railway car, it is necessary to suppress the bending vibration in the up-down (vertical) direction so as to ensure a good riding quality. In order to suppress the bending vibration, it is effective to improve the flexural rigidity of the car body structure, and actual methods for doing so include "increasing the second moment of area of the car body structure" and "increasing the modulus of longitudinal elasticity of the material used for the car body structure".

The most effective means for increasing the second moment of area of the car body structure is to expand the height and width of the car body structure. However, this is not practical since it causes interference with the surrounding infrastructure facilities.

Thus, the practical and effective means for increasing the second moment of area of the car body structure is to increase the thickness of the members constituting the car body structure. However, if the thickness of all the members constituting the car body structure is increased, the mass of the whole structure is increased greatly. Moreover, similarly, if the modulus of longitudinal elasticity of all the material used for the car body structure is increased, the mass of the whole structure is also increased greatly. This is because in general, a material having high modulus of longitudinal elasticity also has high density.

SUMMARY OF THE INVENTION

The object of the present invention is to provide a railway car body structure with a good riding quality by suppressing the bending vibration in the vertical direction of the railway car body, which is provided by a car body structure having an improved flexural rigidity and minimum mass increase.

The present object is achieved by increasing the rigidity of the roof construction at the longitudinal center portion of the car body structure than the rigidity of the roof construction at other portions (by increasing the thickness or the modulus of longitudinal elasticity of the material), or by increasing the rigidity of the lower portion of the side constructions at the longitudinal center portion of the car body structure than the rigidity of the lower portion of the side constructions at other portions.

DETAILED DESCRIPTION OF THE PREFERRED EMBODIMENTS

Figure 1:
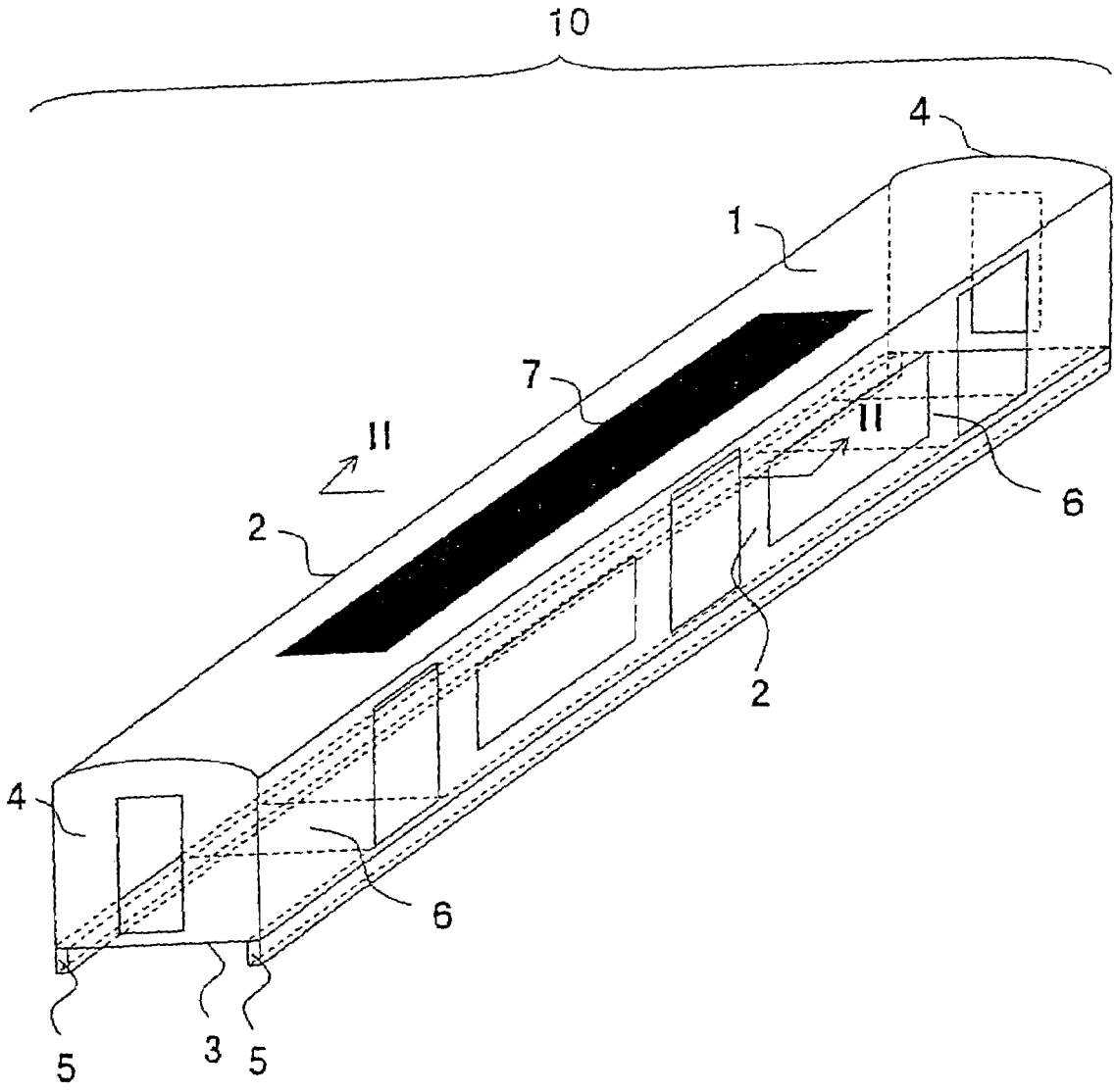
FIG. 1 is a perspective view of a railway car body structure according to a first embodiment of the present invention.

Various embodiments for carrying out the present invention are described hereafter. In the drawings, the same reference numbers as the preceding drawings used in the drawings that follow denote equivalent members, and the detailed descriptions thereof are omitted.

Embodiment 1

Figure 2:
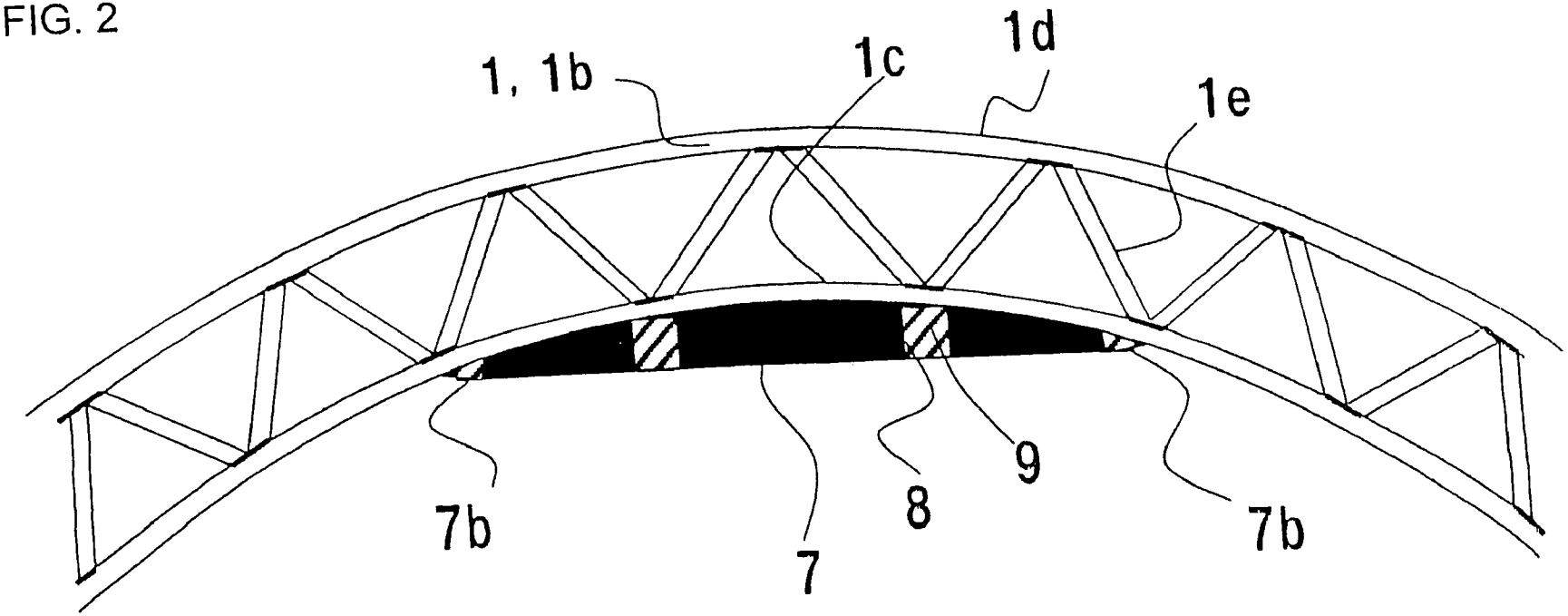
FIG. 2 is a cross-sectional view taken at II-II of FIG. 1.

The first embodiment of the present invention is described with reference to FIGS. 1 and 2. A railway car body structure 10 is composed of a roof construction 1 constituting the upper face thereof, two side constructions 2 constituting the side walls thereof, an underframe 3 constituting the bottom face thereof, and two end constructions 4 constituting the end faces thereof. Side sills 5 are disposed at the lower portion of the side constructions 2. Body bolsters 6 are disposed on the under frame 3 for connecting the underframe 3 and a running gear (not shown).

The roof construction 1, the side constructions 2, the underframe 3 and the end constructions 4 are each formed by welding plural extrusions. The extrusions used for forming the roof construction 1, the side constructions 2 and the underframe 3 are hollow extrusions made of aluminum alloy, and their directions of extrusion correspond to the longitudinal direction of the railway car body structure 10. The extrusions used for forming the end construction 4 are extrusions with ribs made of aluminum alloy, and their directions of extrusion correspond to the vertical direction of the railway car body structure 10.

Figure 19:
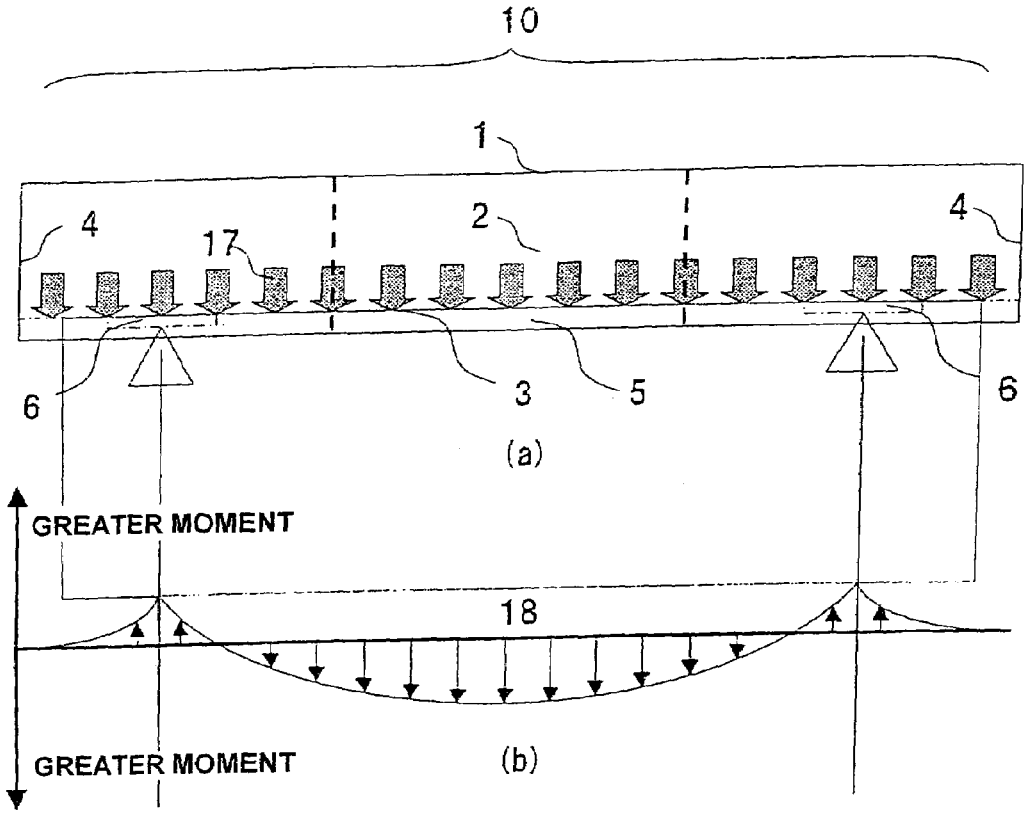
FIG. 19 is an explanatory view for describing the moment of the railway car body structure, wherein (a) is a side view of the railway car body structure, and (b) is a moment distribution diagram.

A deformed status of the railway car body structure 10 will be described with reference to FIGS. 19 and 20. FIG. 19(*a*) is a side view of the railway car body structure 10. The railway car body structure 10 is supported by running gears (not shown) at the longitudinal center of the body bolsters 6.

In addition to its own weight, the railway car body structure 10 is loaded with a load 17 applied vertically to the car body structure 10 by equipments such as electric appliances and passengers on board. The vertical load 17 causes a moment distribution 18 in the railway car body structure 10.

In FIG. 19(*b*), the horizontal axis represents the longitudinal position in the railway car body structure 10, and the vertical axis represents the quantity of moment generated at the corresponding longitudinal position. In proportion to this quantity of moment, a strain distribution 19 is generated as shown in FIG. 20. In this drawing, the vertical axis represents the position in the vertical direction of the railway car body structure 10, and the horizontal axis represents the quantity of strain generated at the corresponding position.

It can be seen from this drawing that the roof construction 1 and the side sills 5 of the railway car body structure 10 are deformed greatly at the longitudinal center area of the structure 10. In other words, in order to effectively improve the flexural rigidity of the railway car body structure 10, it is effective to suppress the deformation of the roof construction 1 and the side sills 5 at the longitudinal center portion of the railway car body structure 10.

Now, the structure of FIG. 2 will be described. A reinforcing plate 7 is attached to a hollow extrusion 1*b* of the roof construction 1 on the inner side of the car body at the longitudinal center portion of the railway car body structure 10. The plate is attached by welding. The welding is performed at the outer circumference portion of the reinforcing plate 7 by fillet welding 7*b*, and at the inner portion of the reinforcing plate 7 by providing a hole 8 that passes through the reinforcing plate 7 and plug welding 9 at the hole 8 to the hollow extrusion 1*b*. However, the inner portion subjected to plug welding does not necessarily have to have the hole 8 filled completely, as long as the plate is welded on in a strengthening manner, so the inner portion can also be attached via fillet welding. The hole 8 is welded onto the crossing point of a face plate 1*c* of the hollow extrusion 1*b* facing the inner side of the car and a connecting plate 1*e* connecting the face plate 1*c* and the face plate 1*d* facing the outer side of the car of the hollow extrusion 1*b*. The welding can be performed either continuously or intermittently at the crossing point along the longitudinal direction of the car body.

The range in which the reinforcing plate 7 is adhered to the railway car body structure 10 in the longitudinal direction of the body is between the two body bolsters 6, substantially symmetric from the longitudinal center of the railway car body structure 10.

The range in which the reinforcing plate 7 is adhered to the railway car body structure 10 in the width direction (width direction of the car body, which is equal to the orthogonal direction with respect to the longitudinal direction of the car body) is approximately half the length in the width direction of the roof construction 1, substantially symmetric from the width-direction center of the roof construction 1.

The above range and the thickness of the reinforcing plate 7 can vary depending on the flexural rigidity required for the railway car body structure 10, the mass restriction for the railway car body structure 10, the allowable space, the work restriction and so on. The reinforcing plate 7 can be formed of plural plates. The change in thickness of the reinforcing plate 7 can be corresponded with by changing the plate thickness of the face plates 1*c* and 1*d* of the hollow extrusion 1*b*.

The thickness of the reinforcing plate 7 is increased gradually toward the center of the car body in the width direction.

In other words, the thickness of the reinforcing plate 7 is increased gradually corresponding to the increase in vertical height of the roof construction 1.

This is because the vertical height of the roof construction 1 generally increases toward the center of width of the car body. The surface of the reinforcing plate 7 facing the outer side of the car (the surface arranged along the face plate 1*c* of the hollow extrusion constituting the roof construction 1 positioned facing the inner side of the car) is machined to correspond to the inner side of the roof construction 1 facing the inner side of the car, so that the surface can be in contact with the face plate 1*c*. The side of the reinforcing plate 7 on the inner side of the car is not machined from the view point of reducing processing costs.

The material of the reinforcing plate 7 is aluminum alloy. Other materials such as steel can be used to form the reinforcing plate 7. If the reinforcing plate 7 is formed of material such as steel having a high modulus of longitudinal elasticity, the rigidity and space thereof are improved, but the recycle ability and the welding ability are deteriorated. If various materials are welded to form the car structure, the different materials must be separated before recycling. Further, it is difficult to mainly use welding as a means for bonding together various materials.

According to this arrangement, the deformation of the roof construction 1 at the longitudinal center of the railway car body structure 10 is suppressed, and the flexural rigidity of the railway car body structure 10 can be improved effectively. Since the arrangement suppresses the bending vibration of the railway car body in the vertical direction, it enables to provide a railway car having a superior riding quality.

According to the present embodiment, the reinforcing plate 7 is attached to the side of the roof construction facing the inner side of the car body, so it does not deteriorate the appearance of the car body compared to when the reinforcing plate is attached to the outer side of the car.

Embodiment 2

Figure 3:
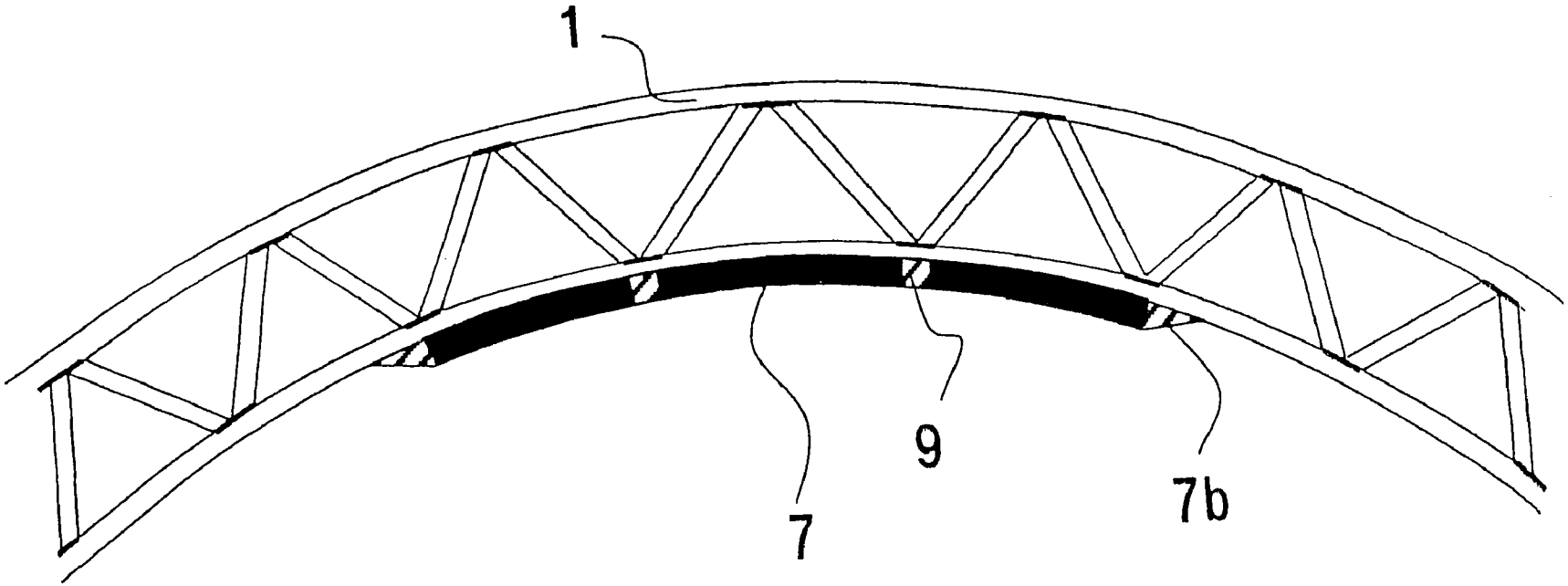
FIG. 3 is a view of a second embodiment of the present invention corresponding to FIG. 2.

The second embodiment of the present invention will be described with reference to FIG. 3. FIG. 3 illustrates an example in which a reinforcing plate 7 having a uniform thickness is provided. The reinforcing plate 7 is bent via machining. The fixing structure of the reinforcing plate 7 is the same as that of FIG. 2.

According to this embodiment, the machining of the side of the reinforcing plate 7 facing the outer side of the car becomes unnecessary, by which the costs can be cut down.

Embodiment 3

Figure 4:
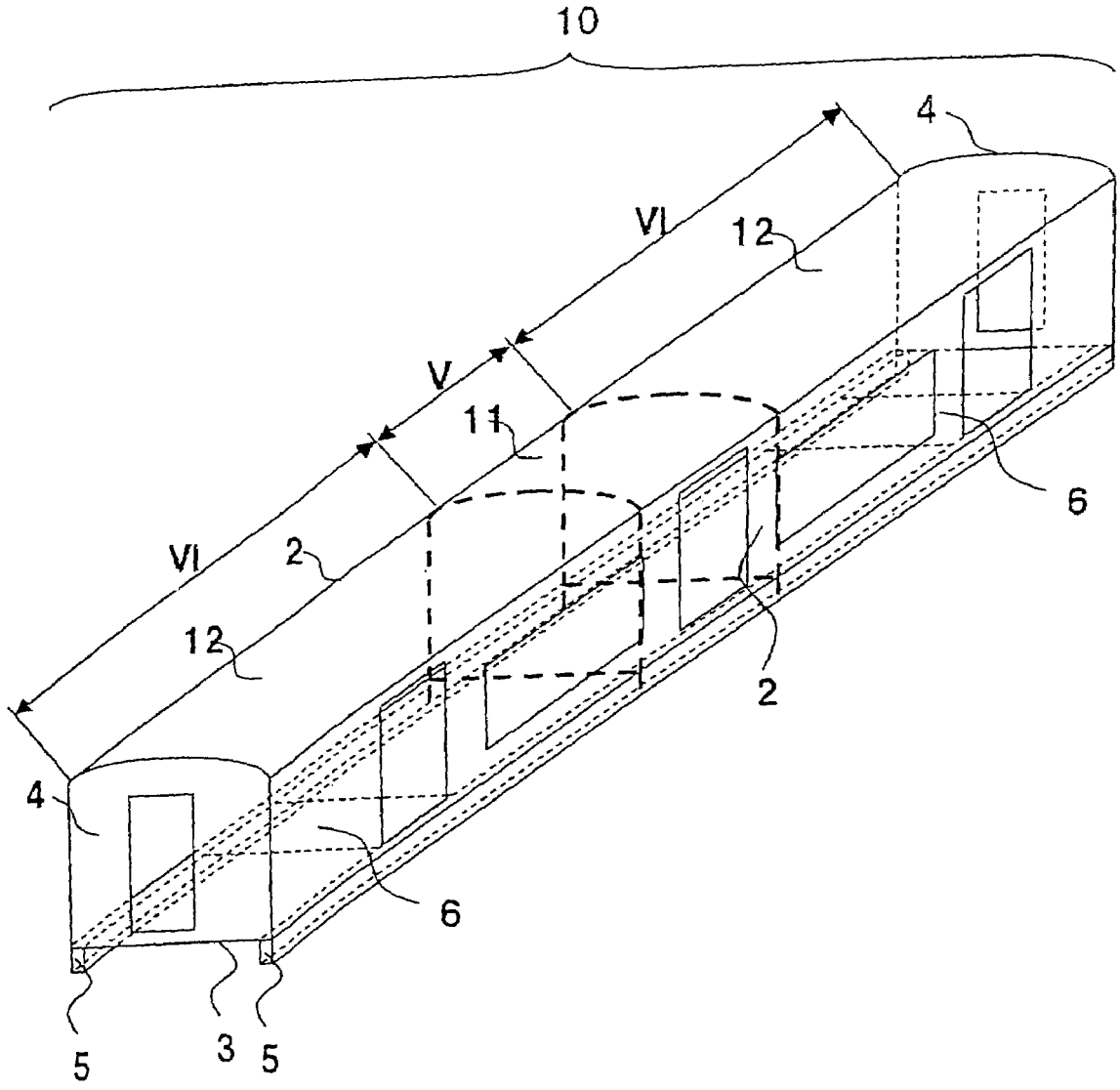
FIG. 4 is a perspective view of a railway car body structure according to a third embodiment of the present invention.
Figure 5:
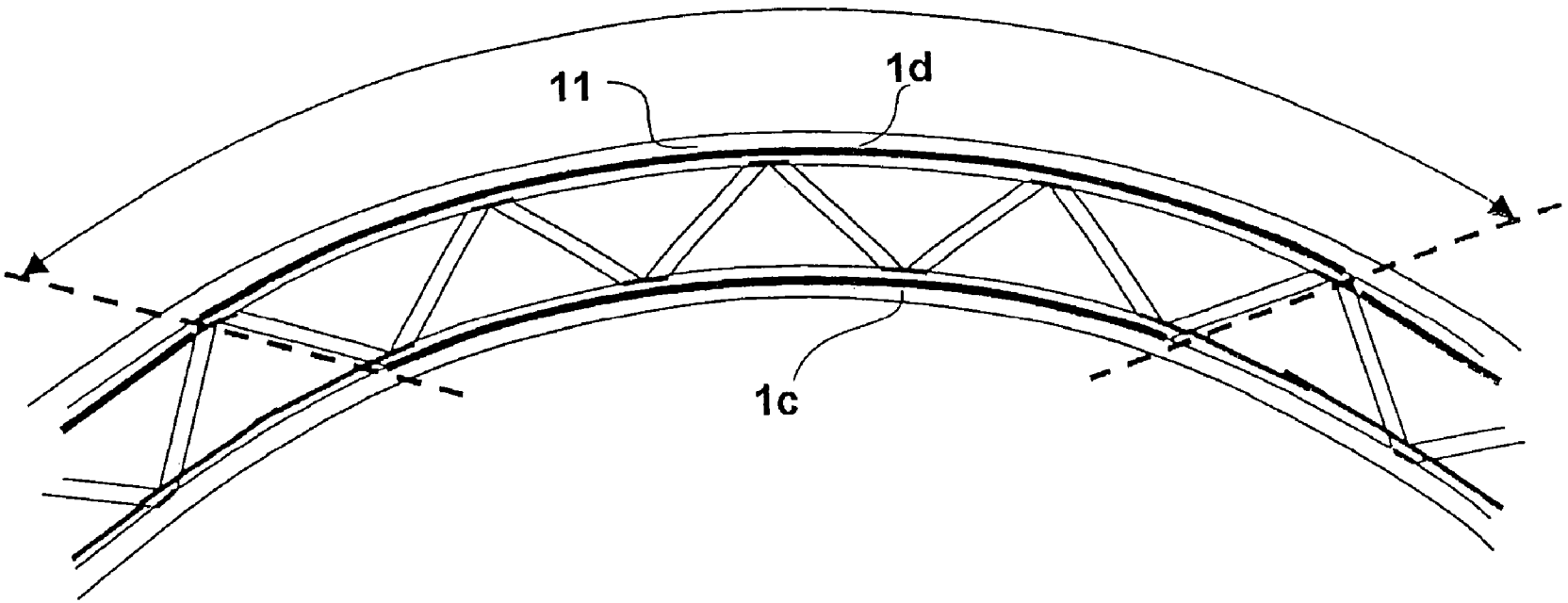
FIG. 5 is a vertical cross-sectional view of a roof construction at portion V of FIG. 4.
Figure 6:
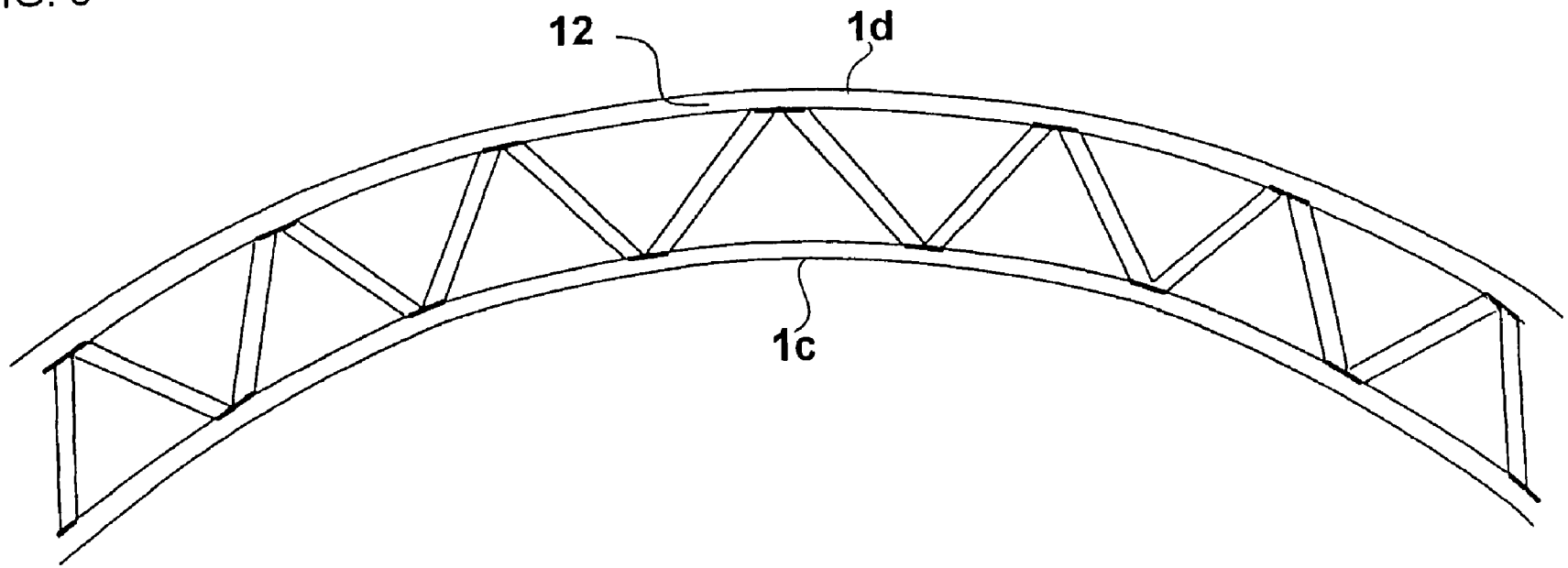
FIG. 6 is a vertical cross-sectional view of a roof construction at portion VI of FIG. 4.

The third embodiment of the present invention will be described with reference to FIGS. 4, 5 and 6. This embodiment does not utilize the reinforcing plate 7.

The thickness of the face plate 1*c* of the hollow extrusion constituting the roof construction 1 facing the inner side of the car body and the face plate 1*d* facing the outer side thereof at the longitudinal center portion of the roof construction 1 (portion V of the drawing) is greater than the thickness of the face plates 1*c* and 1*d* of the hollow extrusion at the longitudinal ends (portions VI) thereof.

According to this embodiment, the reinforcing plate 7 becomes unnecessary, which is advantageous from the viewpoint of space, number of components, welding costs and so on. Further, it should be noted that the frames illustrated by the dashed lines between portions IV and portion V are for indicating sections, and no such frame is actually formed.

Embodiment 4

Figure 7:
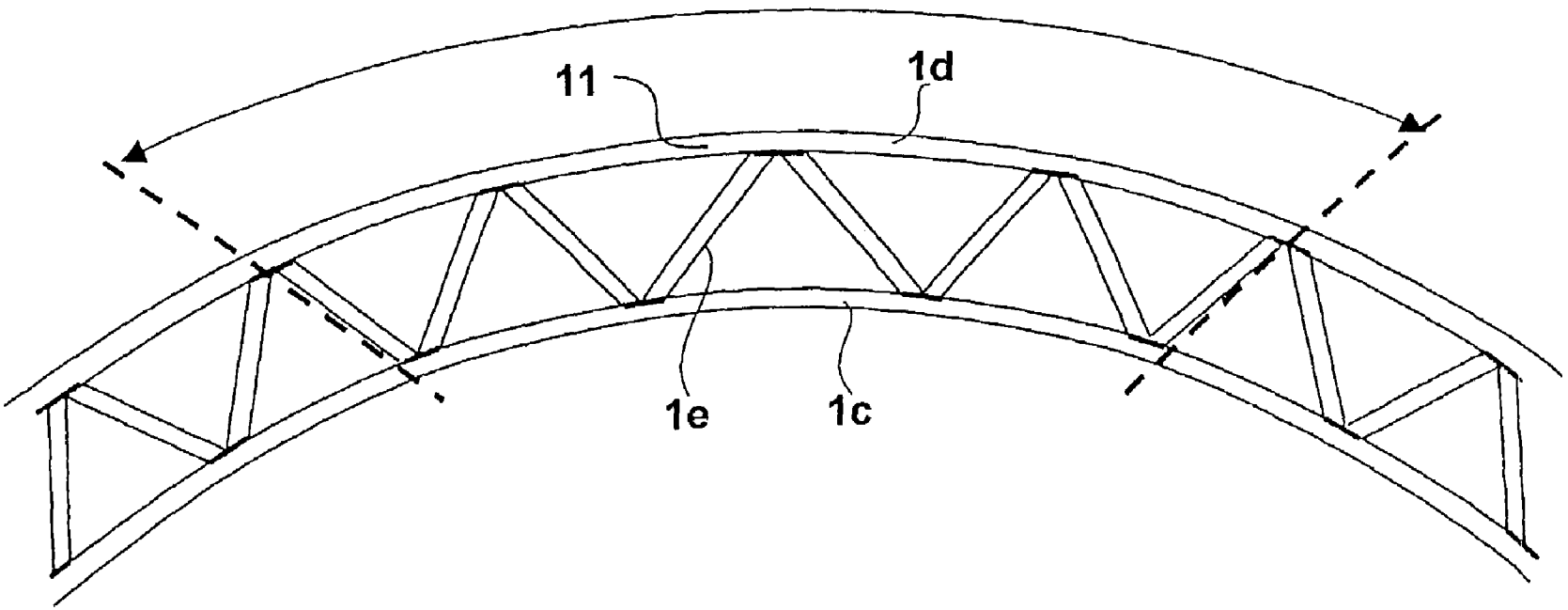
FIG. 7 is a view of a fourth embodiment of the present invention corresponding to FIG. 5.
Figure 8:
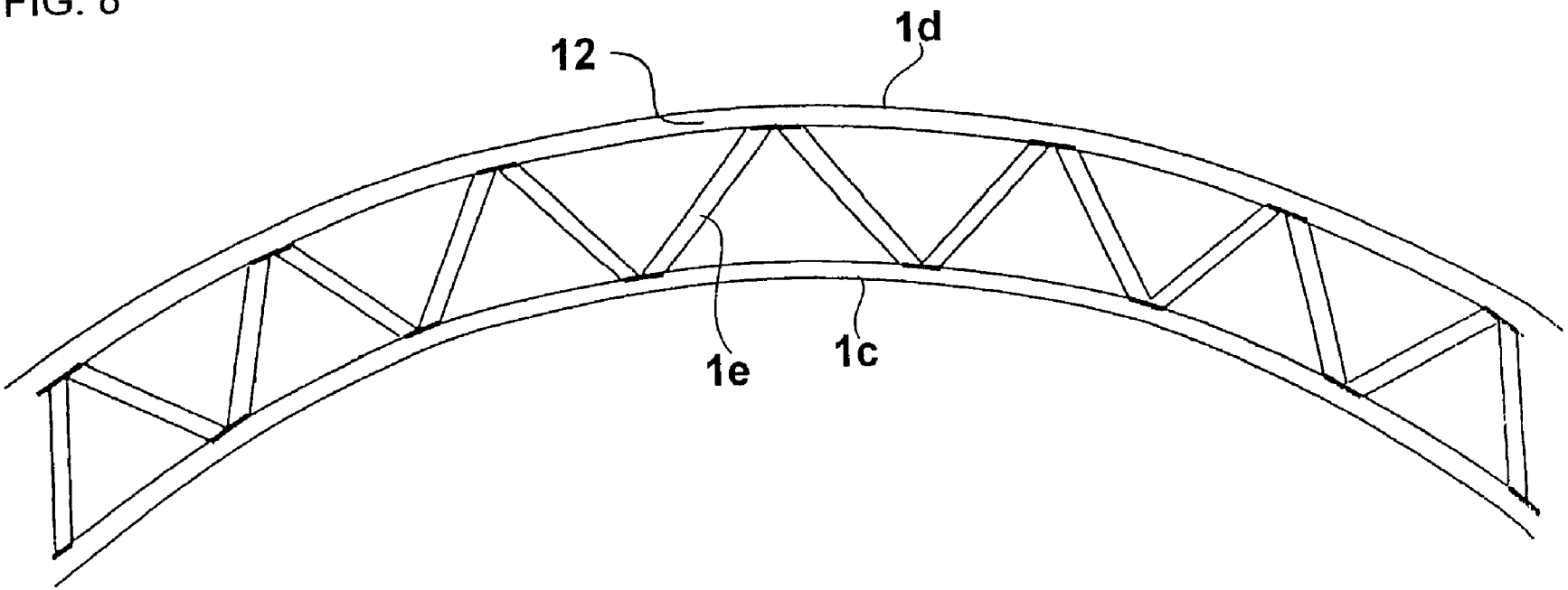
FIG. 8 is a view of the fourth embodiment of the present invention corresponding to FIG. 6.

The fourth embodiment of the present invention will be described with reference to FIGS. 7 and 8. In FIG. 4, the material of the hollow extrusion 11 at the longitudinal center portion V of the roof construction 1 has a high modulus of longitudinal elasticity. The hollow extrusions 12 constituting the longitudinal ends VI of the roof construction 1 are formed of normal hollow extrusion material. If the hollow extrusion at the longitudinal center portion V cannot be formed of hollow extrusions, it can be formed by welding or mechanically connecting a connecting plate (steel-based material) 1*e* to normal panels (steel-based material) 1*c* and 1*d*.

Embodiment 5

Figure 9:
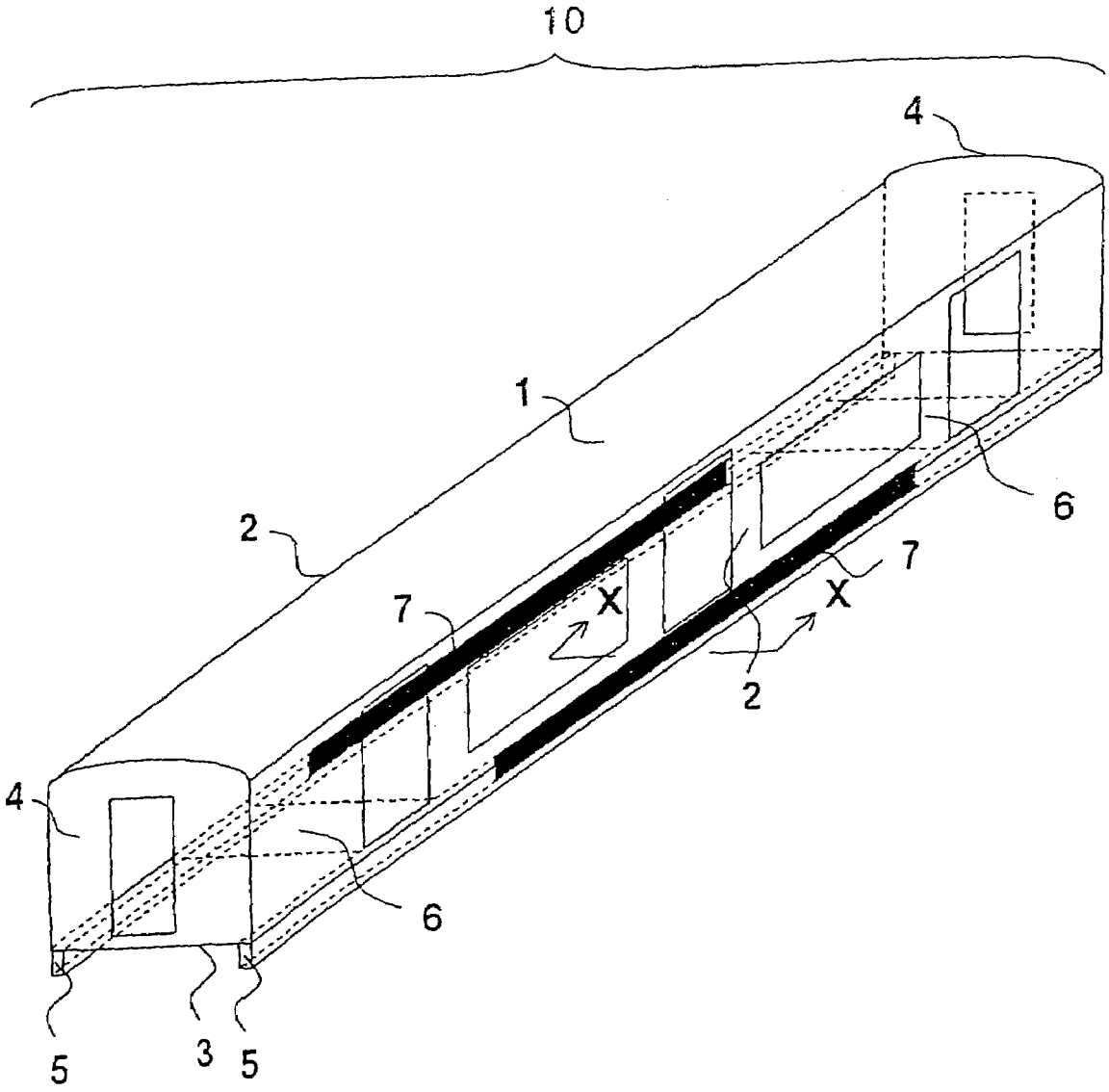
FIG. 9 is a perspective view of the railway car body structure according to a fifth embodiment of the present invention.
Figure 10:
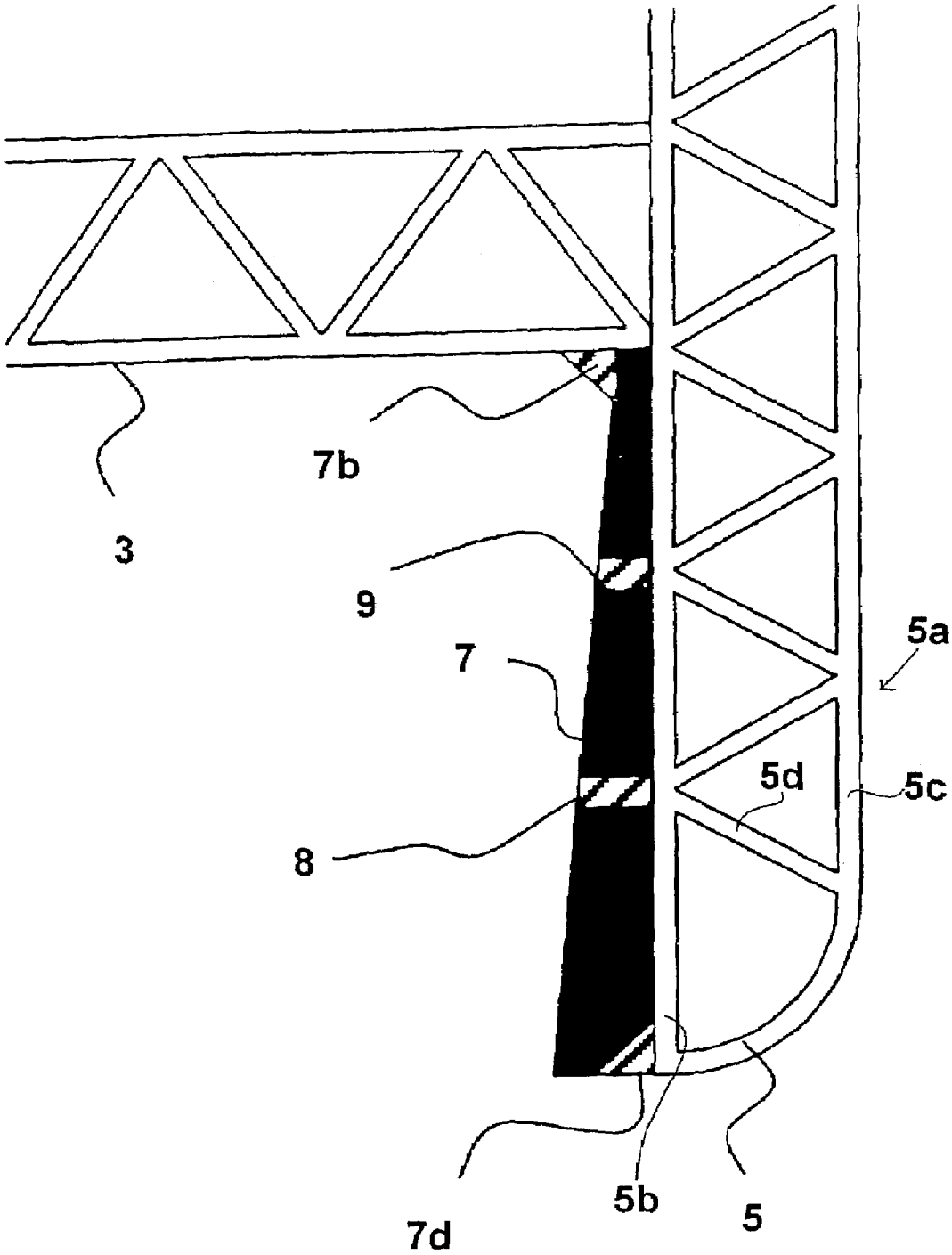
FIG. 10 is a cross-sectional view taken at X-X of FIG. 9.

The fifth embodiment of the present invention will be described with reference to FIGS. 9 and 10. Reinforcing plates 7 are adhered to face plates 5*b* on perpendicular sides of the side sills lower than the horizontal plane of the underframe at the inner side of the car body (inner side does not mean that the side faces the interior of the car, but means that it does not face the outer side of the car) at the longitudinal center portion of the railway car body structure 10. The longitudinal range in which the reinforcing plate 7 is attached to the railway car body structure 10 is between the two body bolsters 6, substantially symmetric from the longitudinal center of the railway car body structure 10. The range in the vertical direction in which the reinforcing plate 7 is attached is the face plates 5*b* on the perpendicular plane of the side sills 5, and the plate 7 is attached by fillet welding 7*c* to the lower surface of the underframe 3. It can be welded to the face plate 5*b* instead of welding to the lower surface of the underframe 3. Furthermore, the lower end of the reinforcing plate 7 can reach and be welded to the lower end of the side sill, but it can also end at the middle of the perpendicular plane. A groove is formed to the lower end of the reinforcing plate 7, using which the plate can be welded via groove welding 7*d*.

The middle area between the upper and lower portions of the reinforcing plate 7 are attached by plug welding 9 to the crossing points between the face plate 5*b* of the hollow extrusion 5*a* on the inner side of the car body and the connecting plates 5*d* connecting the face plate 5*b* with the face plate 5*c* on the outer side of the car body. Holes 8 are formed to the reinforcing plate 7 corresponding to the areas to be subjected to plug welding 9. Fillet welding can be performed instead of plug welding 9.

The thickness of the reinforcing plate 7 is thinner near the under frame than the lower end thereof. This varied thickness is formed via machining. The surface of the reinforcing plate 7 facing the outer side of the car body is machined to fit to the surface of the side sill facing the inner side of the car body. If the perpendicular surface of the side sill 5 facing the inner side of the car body is straight, the surface of the reinforcing plate 7 facing the outer side of the car body is not machined so as to reduce machining costs. The surface of the reinforcing plate 7 facing the inner side of the car body is machined to correspond to the necessary thickness.

The material of the reinforcing plate 7 is aluminum alloy. Other materials such as steel can be used to form the reinforcing plate 7. If the reinforcing plate 7 is formed of material such as steel having a high modulus of longitudinal elasticity, the rigidity and space thereof are improved, but the recycle ability and the welding ability are deteriorated. If various materials are welded to form the car structure, the different materials must be separated before recycling. Further, it is difficult to mainly use welding as a means for bonding various materials.

The above range and the thickness of the reinforcing plate 7 can vary depending on the flexural rigidity required for the railway car body structure 10, the mass restriction for the railway car body structure 10, the allowable space, the work restriction and so on. The reinforcing plate 7 can be formed of plural plates.

If the reinforcing plate 7 is formed of plural panels, the plural panels are welded together via butt welding. If the reinforcing plate 7 is formed of plural panels, the shipping and handling properties thereof are improved but the required number of components and welding costs are disadvantageously increased.

The reinforcing plate 7 can be attached to the roof construction 1 via other methods, such as riveting or bolt engagement. Such methods are mainly used when bonding different metals together.

According to this arrangement, the deformation of the side sills 5 at the longitudinal center portion of the railway car body structure 10 is suppressed, by which the flexural rigidity of the railway car body structure 10 is improved effectively. Since the arrangement suppresses the bending vibration of the railway car body in the vertical direction, it provides a railway car having a superior riding quality. Since the reinforcing plate 7 is increased in thickness toward the lower end, it can correspond to the strain increasing away from the vertical center of the car body, as shown in FIG. 20.

Embodiment 6

Figure 11:
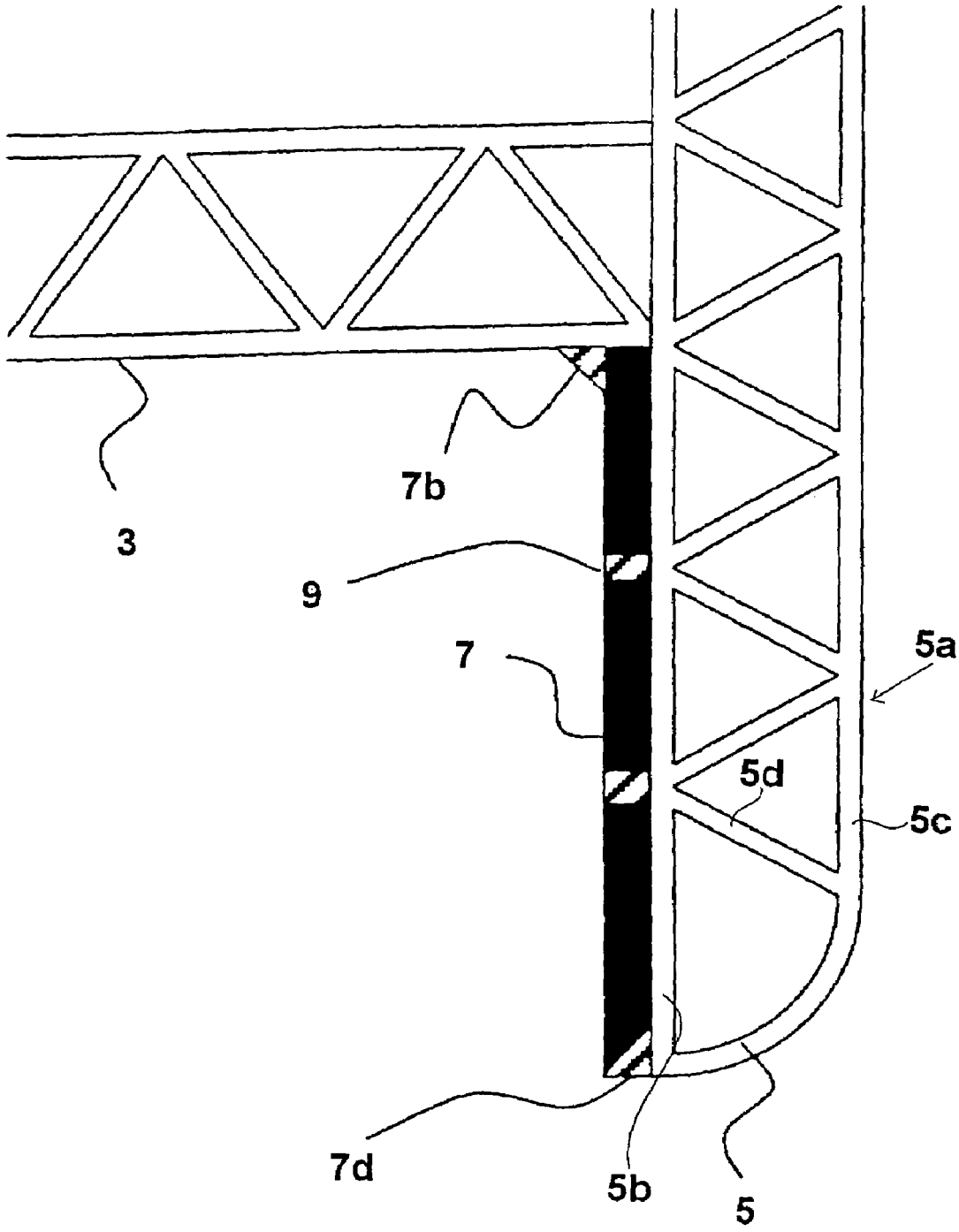
FIG. 11 is a view of a sixth embodiment of the present invention corresponding to FIG. 10.

The sixth embodiment of the present invention will be described with reference to FIG. 11. FIG. 11 illustrates an example in which the thickness of the reinforcing plate 7 is uniform. If the perpendicular surface 5*b* of the side sill 5 facing the inner side of the car body is curved, the reinforcing plate 7 is also curved to correspond to the curved inner surface. If the perpendicular surface of the side sill 5 facing the inner side of the car body is straight, the surface of the reinforcing plate 7 facing the outer side of the car body is not machined so as to reduce machining costs.

Embodiment 7

Figure 12:
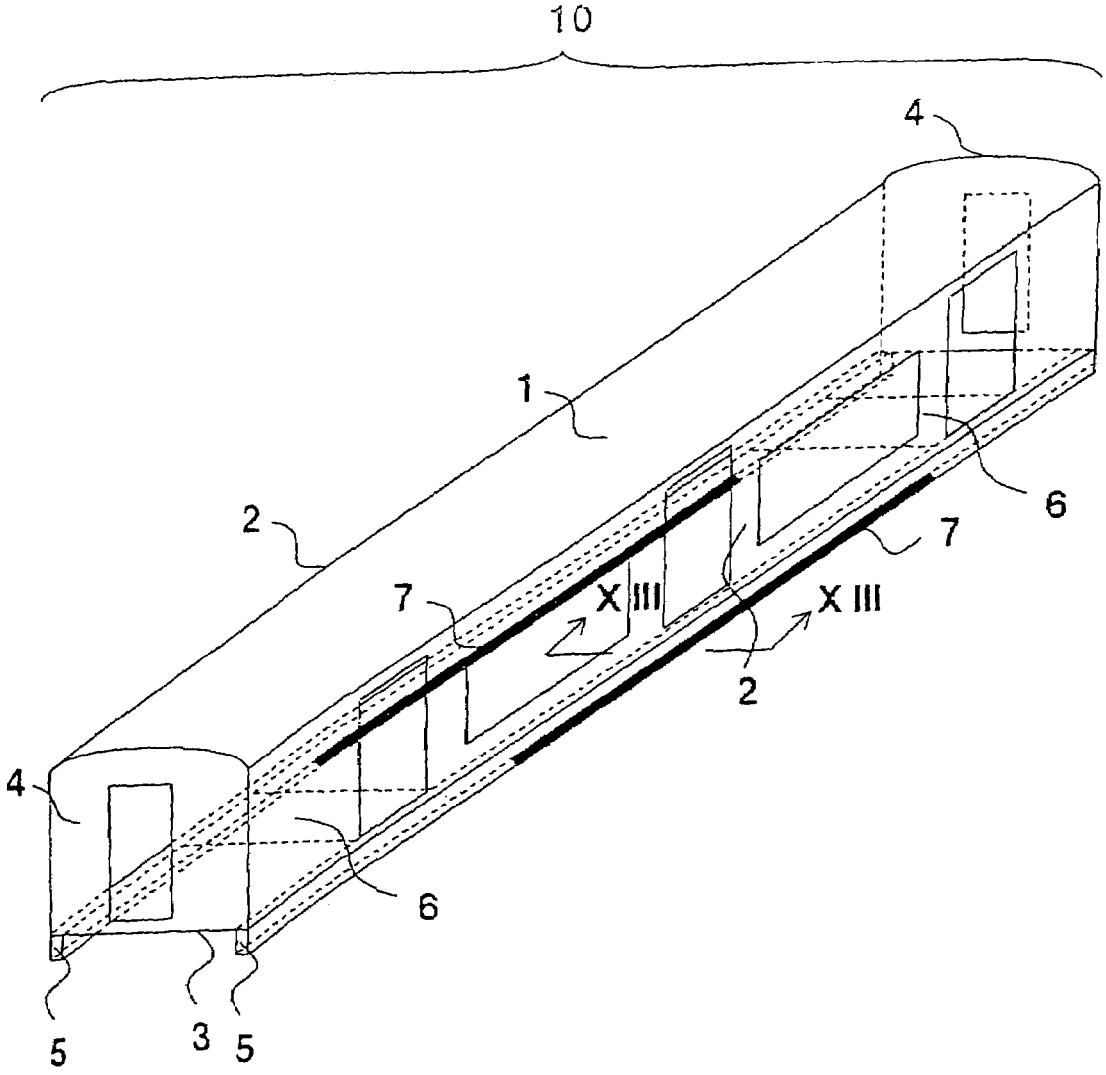
FIG. 12 is a perspective view of the railway car body structure according to a seventh embodiment of the present invention.
Figure 13:
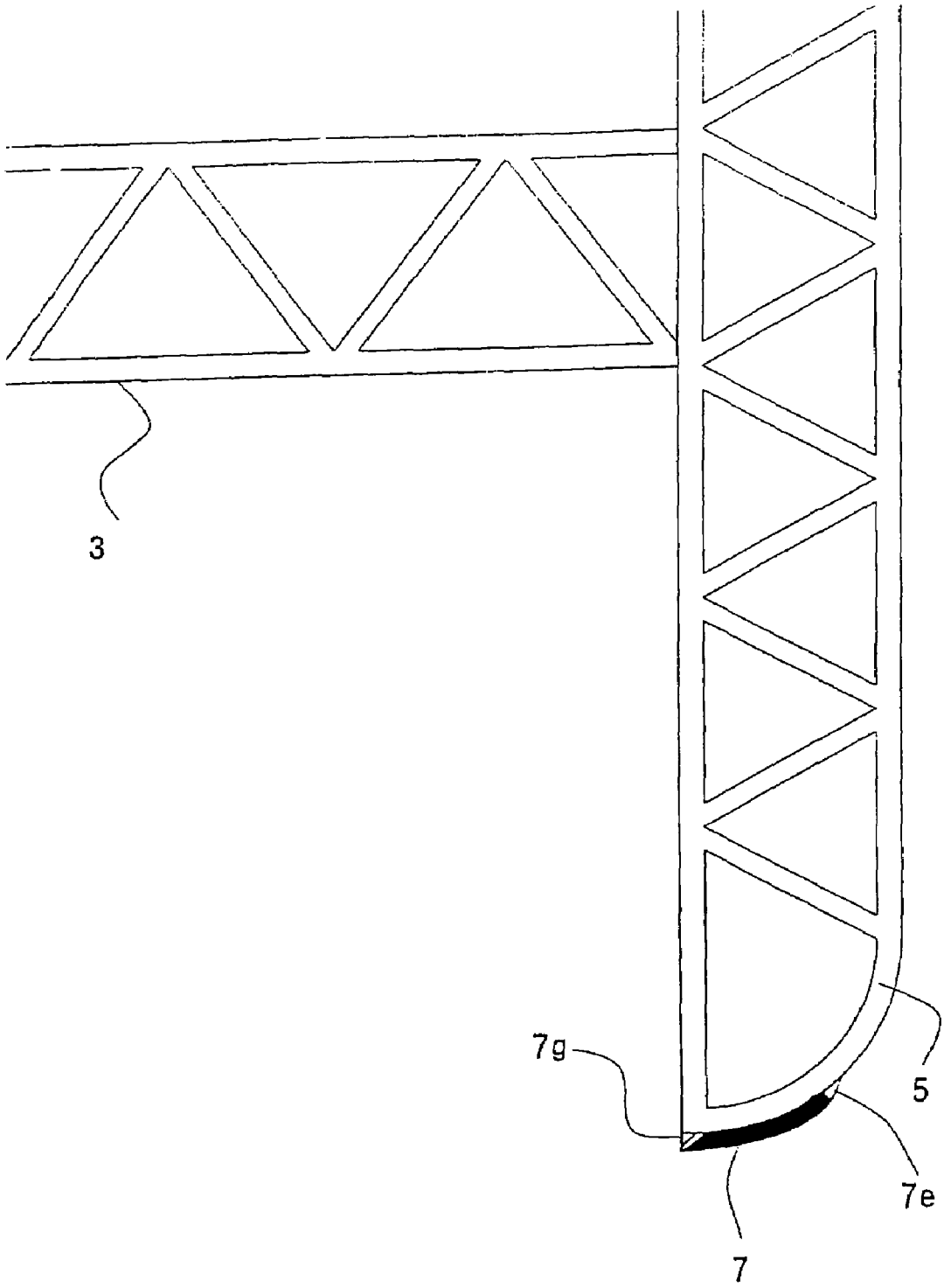
FIG. 13 is a cross-sectional view taken at XIII-XIII of FIG. 12.

The seventh embodiment of the present invention will be described with reference to FIGS. 12 and 13. According to this embodiment, the reinforcing plate 7 is curved in an arc to correspond to a curved surface at the lowermost surface of the side sill 5. The side of the reinforcing plate 7 facing the outer side of the car body is attached to the hollow extrusion via fillet welding 7*e*. A groove is provided to the reinforcing plate at a portion near the inner side of the car body between the hollow extrusion, which is used to perform groove welding 7*g*.

Figure 20:
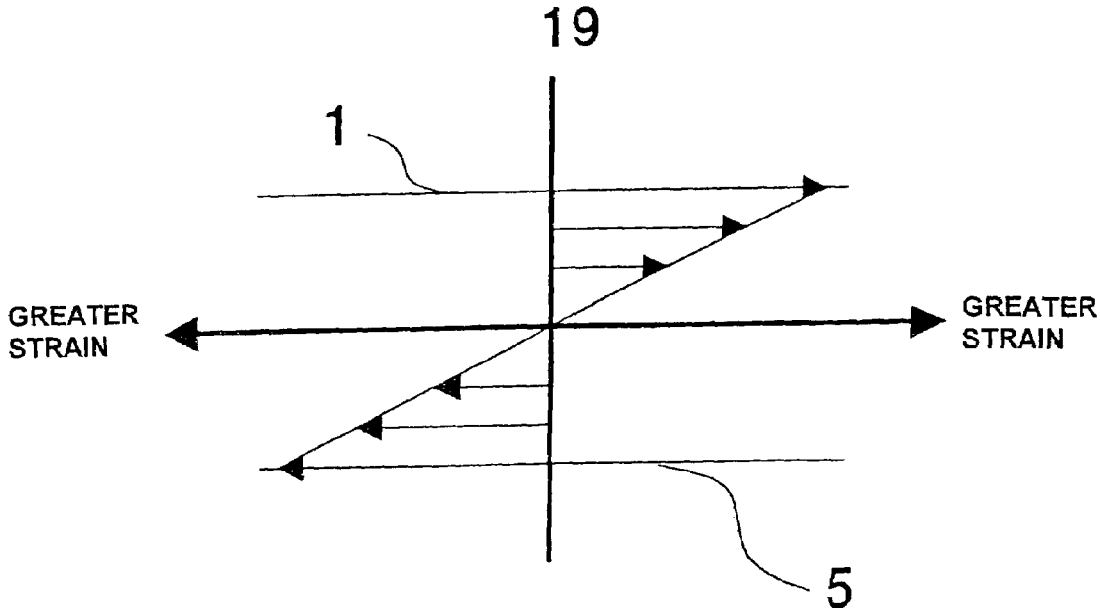
FIG. 20 is an explanatory view showing the distribution of strain in the perpendicular direction of the railway car body structure.

As shown in FIG. 20, since the strain increases away from the vertical center of the car body, the reinforcing plate 7 can be conveniently attached to areas where there is large strain.

According to this arrangement, the reinforcing plate can be downsized.

Embodiment 8

Figure 14:
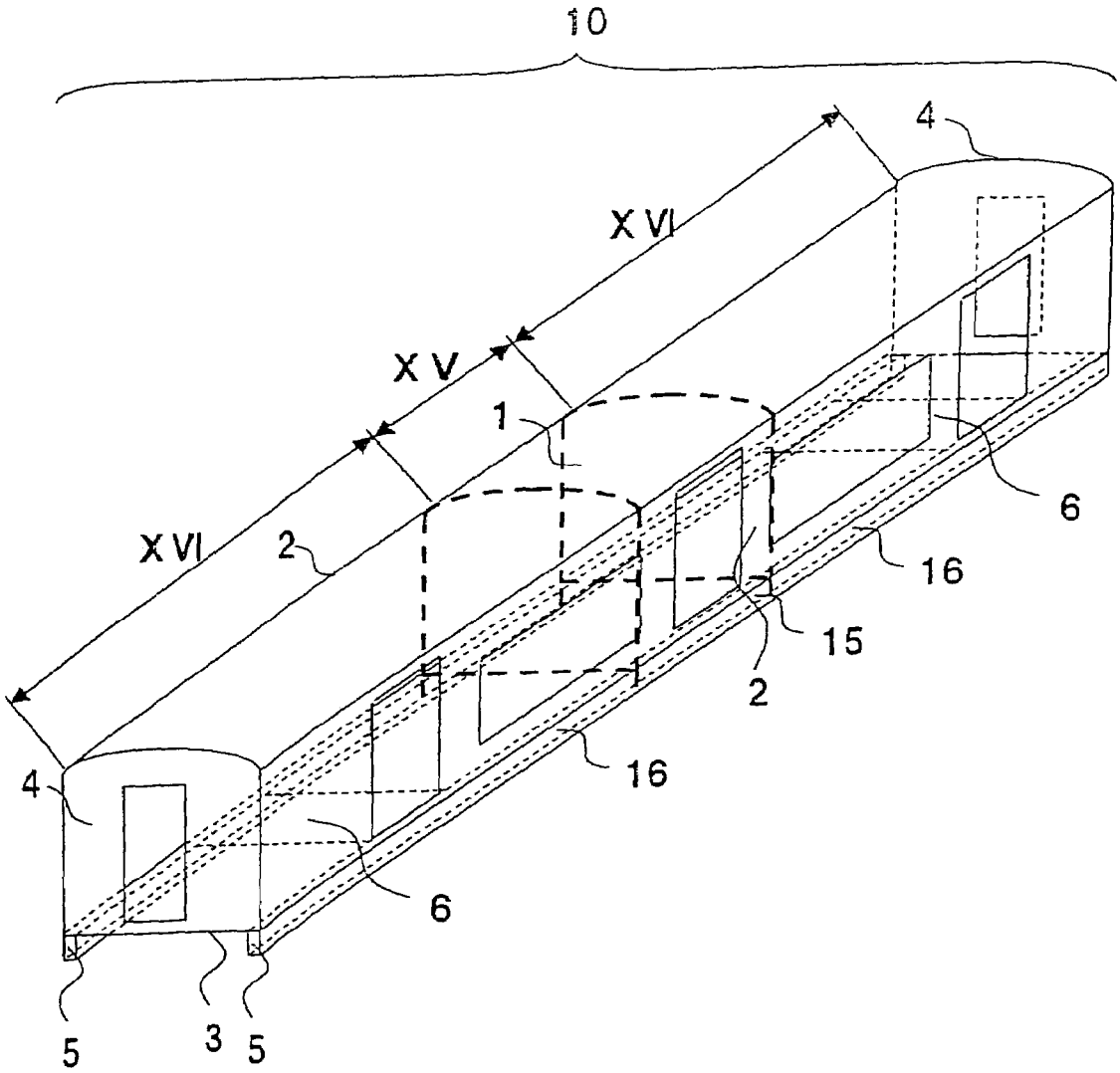
FIG. 14 is a perspective view of the railway car body structure according to an eighth embodiment of the present invention.
Figure 15:
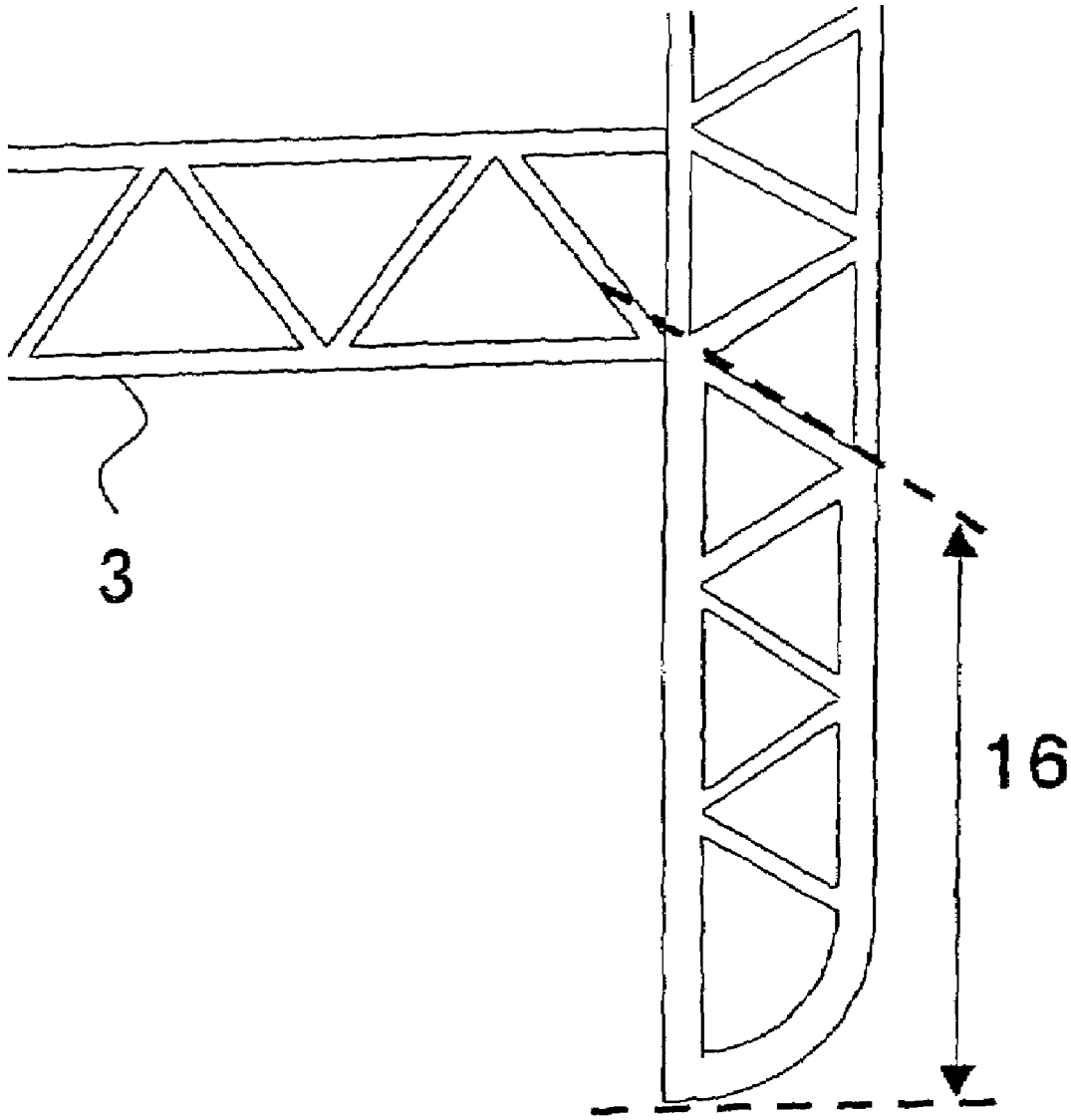
FIG. 15 is a cross-sectional view taken at XV-XV of FIG. 14.
Figure 16:
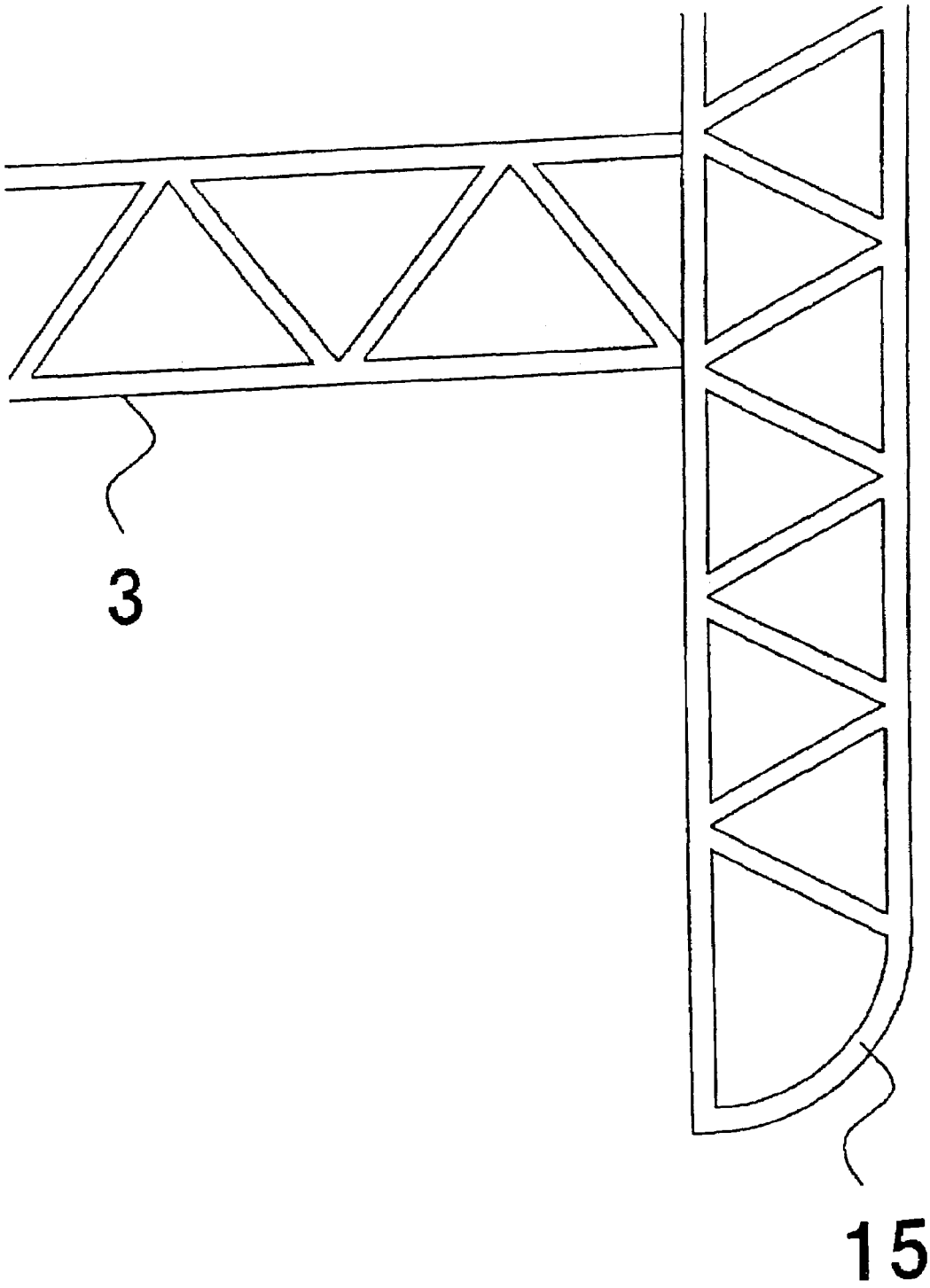
FIG. 16 is a cross-sectional view taken at XVI-XVI of FIG. 14.

The eighth embodiment of the present invention will be described with reference to FIGS. 14, 15 and 16. The present embodiment suppresses the deformation of the side sill 5 not by attaching a reinforcing plate 7 but by increasing the thickness of the side sill 5. The thickness of a lower portion 16 of the side sill 5 at the longitudinal center portion (referred to as portion XV) of the railway car body structure 10 is thicker than a lower portion 15 of the side sill 5 at the longitudinal ends (referred to as portion XVI) of the railway car body structure 10.

According to this arrangement, the attachment of a reinforcing plate 7 is not necessary, which is advantageous from the viewpoint of effective space, number of components and welding costs.

Embodiment 9

Figure 17:
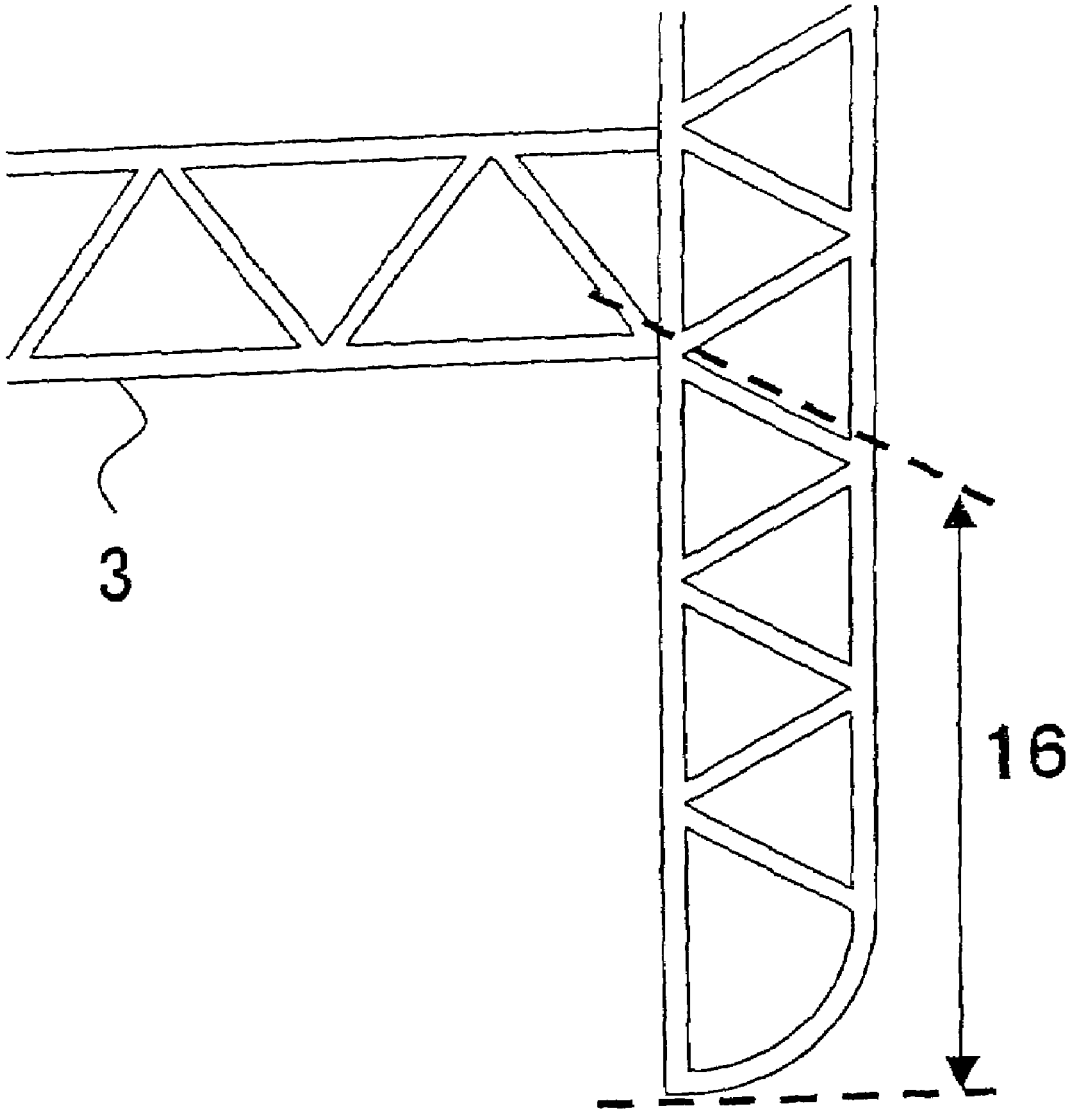
FIG. 17 is a view of a ninth embodiment of the present invention corresponding to FIG. 15.
Figure 18:
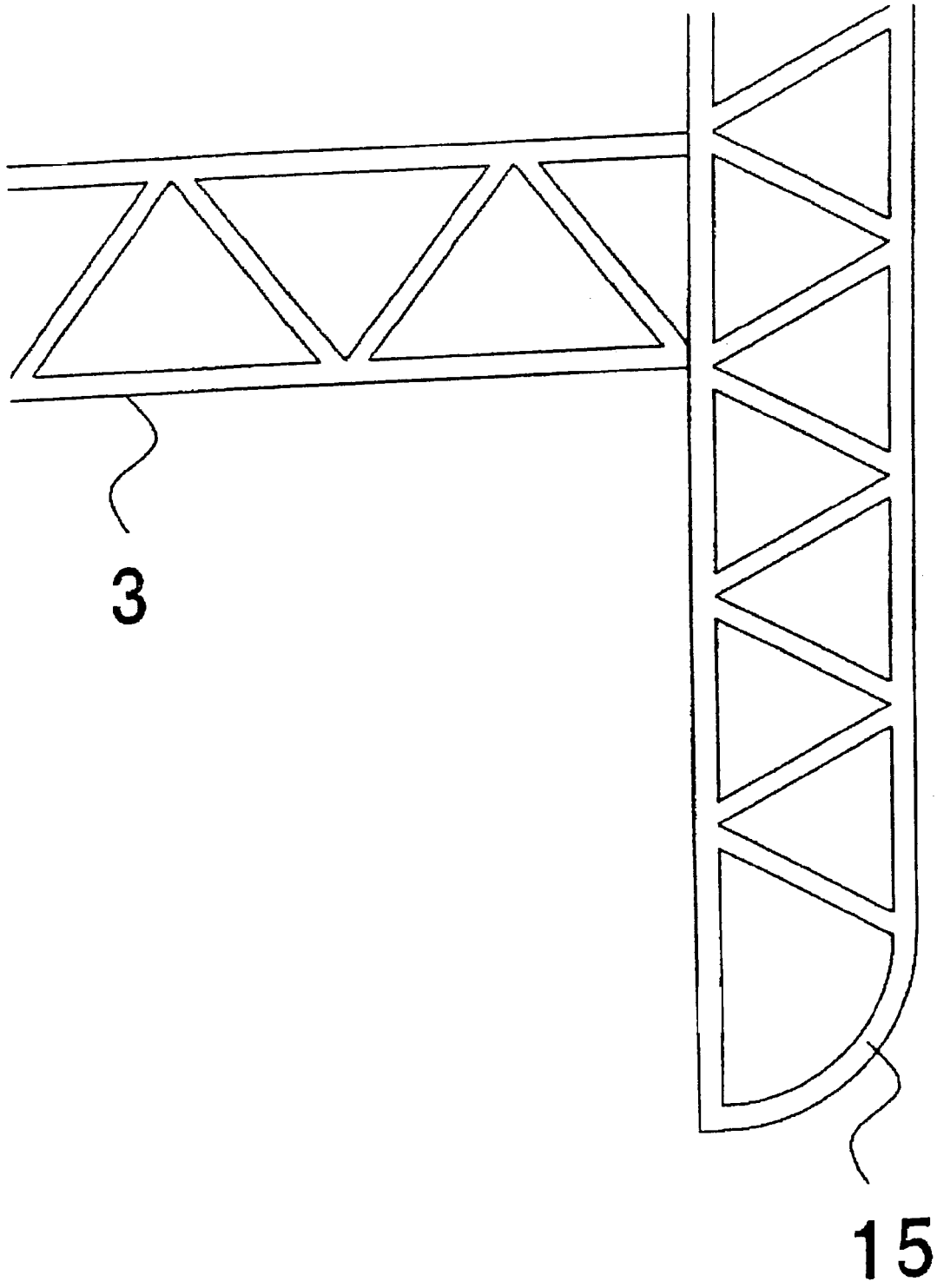
FIG. 18 is a view of a ninth embodiment of the present invention corresponding to FIG. 16.

The ninth embodiment of the present invention will be described with reference to FIGS. 17 and 18. According to this embodiment, the modulus of longitudinal elasticity of the material forming the lower portion 16 of the side sill 5 at the longitudinal center portion (referred to as portion XV) of the side sill 5 is greater than the modulus of longitudinal elasticity of the material forming the lower portion 15 of the side sill 5 at the longitudinal ends (referred to as portion XVI) thereof.

According to this arrangement, there is no need to increase the thickness of the lower portion 16 of the side sill 5 at the longitudinal center portion (portion XV) of the side sill 5, so the shape of the side sills 5, in other words, the shape of the railway car body structure 10, can be made uniform. The technical scope of the present invention is not restricted to the language used in the embodiments, but is extended to the range in which a person skilled in the art could easily substitute based on the present disclosure.

What is claimed is:

1. A car body structure comprising a roof construction or a side sill of an underframe having a higher rigidity at a longitudinal center portion of the car body structure than the rigidity of the other portions of the roof construction or the side sill, wherein the thickness of the roof construction at the longitudinal center portion of the car body structure facing an inner side of the car is increased by adhering a reinforcing plate to the roof construction facing the inner side of the car;

the roof construction is a hollow extrusion; and the reinforcing plate is welded to a face plate of the hollow extrusion facing the inner side of the car, wherein the whole circumference of the reinforcing plate is attached by fillet welding, and the reinforcing plate is further attached by plug welding to a crossing point between a face plate of the hollow extrusion facing the inner side of the car and a connecting plate.

2. The car body structure according to claim 1, wherein a modulus of longitudinal elasticity of a material constituting the roof construction at the longitudinal center portion of the car body structure is greater than the modulus of longitudinal elasticity of the material constituting other portions of the roof construction.

3. The car body structure according to claim 1, wherein the modulus of longitudinal elasticity of the material constituting the roof construction at the longitudinal center portion is increased toward a center in a width direction of the roof construction.

4. A car body structure comprising a roof construction or a side sill of an underframe having a higher rigidity at a longitudinal center portion of the car body structure than the rigidity of the other portions of the roof construction or the side sill, wherein the thickness of the side sill at the longitudinal center portion facing the side opposite from the outer side of the car body is increased by adhering a reinforcing plate to the side opposite from the outer side of the car body;

the side sill is a hollow extrusion; and the reinforcing plate is welded to the side opposite from the outer side of the car body, the whole circumference of the reinforcing plate being welded by fillet welding, and the reinforcing plate being welded by plug welding to a crossing point between a face plate facing the opposite side from the outer side of the car body and a connecting plate connecting a face plate of the hollow extrusion facing the outer side of the car body and the face plate facing the opposite side.

5. The car body structure according to claim 4, wherein a modulus of longitudinal elasticity of a material forming a lower portion of the side sill at the longitudinal center portion of the car body structure is increased gradually toward the lower end portion of the side sill.

* * * * *